US005644889A

United States Patent [19]

Getz

[11] Patent Number: 5,644,889

[45] Date of Patent: Jul. 8, 1997

[54] REMEDIAL WALL ANCHOR SYSTEM

[75] Inventor: Stephen H. Getz, Michigan City, Ind.

[73] Assignee: Dur-O-Wal, Inc., Arlington Heights, Ill.

[21] Appl. No.: 286,857

[22] Filed: Aug. 5, 1994

[51] Int. Cl.[6] ..... E04B 1/38; F16B 13/00

[52] U.S. Cl. ..... 52/713; 52/514; 52/802; 52/506.05; 52/745.21; 52/514.5; 411/55; 411/60; 411/383

[58] Field of Search ..... 52/713, 707, 712, 52/703, 698, 379, 383, 426, 428, 431, 432, 434, 506.05, 506.06, 508, 513, 514, 514.5, 562, 565, 127.7, 743.13, 743.14, 745.21; 411/55, 60, 400, 383, 384; 403/79, 157, 353

[56] References Cited

U.S. PATENT DOCUMENTS

| | | | |
|---|---|---|---|
| 1,053,231 | 2/1913 | Schweikert | 52/562 X |
| 1,472,642 | 10/1923 | Evans | 52/379 |
| 1,807,405 | 5/1931 | Heitmann | 52/707 X |
| 2,071,069 | 2/1937 | Heitman | 52/713 X |
| 2,079,538 | 5/1937 | Wheeler et al. | 52/713 X |
| 3,277,626 | 10/1966 | Brynjolfsson | 52/379 X |
| 3,377,764 | 4/1968 | Storett | 52/379 X |
| 3,462,179 | 8/1969 | Hinkle | 403/157 |
| 3,890,758 | 6/1975 | Bouchard | 52/713 |
| 4,366,651 | 1/1983 | Thomas et al. | 52/562 X |
| 4,606,163 | 8/1986 | Catani . | |
| 4,772,166 | 9/1988 | Shamah et al. | 411/55 X |
| 4,790,114 | 12/1988 | Falco | 52/707 |
| 4,875,319 | 10/1989 | Hohmann . | |
| 4,883,396 | 11/1989 | Shamah et al. . | |
| 5,212,920 | 5/1993 | Tye | 52/707 X |
| 5,408,798 | 4/1995 | Hohmann | 52/713 X |

FOREIGN PATENT DOCUMENTS

| | | | |
|---|---|---|---|
| 3542206 | 6/1987 | Germany | 52/713 |
| 2179990 | 3/1987 | United Kingdom | 52/562 |
| 2181468 | 4/1987 | United Kingdom | 52/713 |
| 2217766 | 11/1989 | United Kingdom | 52/562 |

OTHER PUBLICATIONS

1995 Sweet's Catalog File 04150/HOH 2 pages, 04150 DUR pp. 6 & 7 1 page from Heckman.

Dur–O–Wal, Inc., "Dur–O–Pair™ Epoxy Anchor," (Catalog R–192) 1992.

Dur–O–Wal, Inc., "Repair Anchor for Facade Stabilization," (Catalog R–287) 1989.

Dur–O–Wal, Inc., "Dur–O–Wal Repair Anchors for Metal Studs, Steel Back–up and Wood Stud Back–up, " (Catalog R–589) 1989.

Gunnebo Fastening, "Veneer Stabilizing Anchor," (undated product bulletin).

Stephen H. Getz, "Facade Restoration: Rehabilitating Unstable Veneers," *The Construction Specifier*, Apr. 1989.

*Primary Examiner*—Robert Canfield

*Attorney, Agent, or Firm*—Jenner & Block

[57] ABSTRACT

A remedial wall anchor system includes a reinforcing rod or wire, a tie rod, anchor components which secure the tie rod to the facade wall and the back-up wall, and a capturing device. The tie rod extends between the facade and back-up walls and is insertable through a hole extending through the facade wall. The capturing device is secured to the front end of the tie rod and includes first and second spaced-apart upstanding surfaces joined by a linking member to form a channel for capturing a portion of the reinforcing wire. The remedial anchor system can be used both mechanical and adhesive facade anchors and back-up anchors. The remedial anchor wall system is easily and economically used to reconnect an existing facade wall to a back-up wall. Initially, the user forms a horizontal groove in a mortar bedjoint of the facade wall. Then, a hole is drilled into the grooved mortar line so that the hole is connected to the groove and extends through the facade wall. The tie rod of the remedial wall anchor system is inserted into the hole so that rod extends between the facade wall and the back-up wall and is secured to the facade and back-up walls. Finally, a reinforcing rod or wire is positioned within the groove adjacent the tie rod and a portion of the reinforcing wire is captured to the tie rod to secure the reinforcing wire to the rest of the remedial wall anchor system.

20 Claims, 3 Drawing Sheets

REMEDIAL WALL ANCHOR SYSTEM

FIELD OF THE INVENTION

This invention relates generally to wall anchor systems, and more particularly, to remedial wall anchor systems for connecting an existing brick facade wall to a backup structure.

BACKGROUND OF THE INVENTION

A well-known masonry building construction method uses dual walls consisting of a brick veneer or facade wall and a back-up wall that can be load bearing or constituted of various materials. The method is popular because it permits the use of a variety of aesthetically-pleasing outside wall materials, such as brick, concrete block, stone, terra cotta, or other similar materials. During construction, the facade wall and the back-up wall are mechanically or otherwise connected to ensure the structural integrity of both walls. Frequently, however, the exterior structural integrity and esthetics of such dual-wall systems degrade over time and lead to facade instability. A number of factors can cause or contribute to facade instability. For example, facade instability can occur because during construction the ties connecting the facade and back-up wall were omitted, were improperly placed, or were improperly installed. Facade instability can also occur because of excessive differential wall movement created by thermal movement, creep, moisture, and settlement. In addition, environmental factors can lead to corrosion of the tie elements used to connect the faced and back-up walls.

Remedial anchor wall systems are used to re-connect an existing facade wall to a back-up wall to thereby correct and overcome facade instability. One typical mechanical remedial wall anchor system consisting of a back-up anchor and a facade anchor attached to opposite ends of a central threaded bolt. The remedial system is used by first drilling a hole through the entire depth of the facade wall and through at least a portion of the depth of the back-up wall. The anchor system is then inserted into the hole with the back-up anchor placed in the back-up wall and the facade anchor placed in the facade wall. The two anchors are tightened or otherwise deployed to thereby re-connect the facade wall to the back-up wall. Finally, mortar can be applied to the facade wall to cover the hole containing the remedial anchor. A second type of remedial wall anchor system uses a tie-member embedded within and bonded to an adhesive-filled tubular wire screen to connect the tie-member to the facade and back-up walls.

Known remedial wall anchor systems, however, do not adequately correct facade instability in all types of dual wall structures. Some dual wall structures require reinforcing rods or wires embedded within the facade wall to increase the strength, ductility and stability of the facade wall. For example, building structures subject to seismic or wind loads frequently have a continuous reinforcing rod or wire embedded in the mortar of the facade wall. The rod or wire imparts additional stability and ductility to the dual-wall system and helps to counteract lateral stresses induced by in-plane and out-of-plane movement of the facade wall. The rod or wire is attached or otherwise connected to the wall anchors which tie the facade wall to the back-up wall. Known remedial wall anchor systems do not adequately correct facade instability in such building structures because the systems do not connect the reinforcing rods or wires to the anchor system. On the other hand, known wall anchor systems utilizing reinforcing rods or wires cannot be used to re-connect existing facade and back-up walls without removing and replacing large portions of the facade wall.

A need therefore exists for a remedial anchor wall system which connects the reinforcing rod or wire to a wall anchor system in an existing dual wall structure.

SUMMARY OF THE INVENTION

It is an object of this invention to provide a remedial wall anchor system which connects a reinforcing rod or wire to a wall anchor system positioned in an existing dual wall structure and thus can be used to correct facade instability in dual wall structures which require reinforcing rods or wires embedded within the facade wall.

Another object of this invention is to provide a capturing device which connects a reinforcing rod or wire with a wall anchor system positioned within an existing dual wall structure.

A further object is to provide a capturing device for capturing a portion of a reinforcing rod or wire to a wall anchor system in an existing dual wall structure and which can be used with either mechanical or adhesive wall anchors.

In keeping with these objectives, a remedial wall anchor system is provided that can be economically used to re-connect an existing facade wall to a back-up wall. The system includes a reinforcing rod or wire, a tie rod, anchor components which secure the tie rod to the facade wall and the back-up wall, and a capturing device. The tie rod extends between the facade and back-up walls and is insertable through a hole extending through the facade wall. The capturing device is secured to the front end of the tie rod and includes first and second spaced-apart upstanding surfaces joined by a connecting member to form a channel for capturing a portion of the reinforcing rod. The remedial anchor system can be used with a variety of facade anchors and back-up anchors. For example, the tie rod can be secured to the dual wall structure by mechanical facade and back-up anchors. Alternatively, an adhesive anchor can be used to secure the tie rod to both the facade and back-up walls.

An activation or setting tool is used to secure the capturing device to the threaded end segment of the tie member. The tool includes two sections: an elongated section and a generally cylindrical section. The elongated section is used to activate the back-up anchor and includes an internally threaded bore for engaging the threaded tie member. The elongated section also includes a handle for applying torque to the setting tool. The cylindrical section is used to activate the facade anchor and includes an asymmetrically-shaped head having a shelf which is sized to extend over and abut the tab of the capturing device. The cylindrical section is coupled to the elongated section by a pair of slots positioned at one end of the cylindrical section opposite the head and a pair of outwardly projecting tangs positioned at one end of the elongated section opposite the handle and sized to engage the slots of the cylindrical section. When torque is applied to the handle of the tool, the shelf transfers the torque to the tab causing the capturing device to rotate and move against the facade anchor.

A remedial anchor wall system according to the invention is easily and economically used to re-connect an existing facade wall to a back-up wall. Initially, the user forms a horizontal groove into one of the horizontal mortar bedjoints in the facade wall. Then, a hole is drilled into the grooved mortar bedjoint so that the hole is normal to and connected to the groove and extends through the facade wall. The tie rod of the remedial wall anchor system is inserted into the hole so that rod extends between the facade wall and the back-up wall and is secured to the facade and back-up walls. Finally, a reinforcing rod or wire is positioned within the groove adjacent the tie rod and a portion of the reinforcing rod is captured to the tie rod to secure the reinforcing rod to the rest of the remedial wall anchor system.

DETAILED DESCRIPTION

Figure 1:
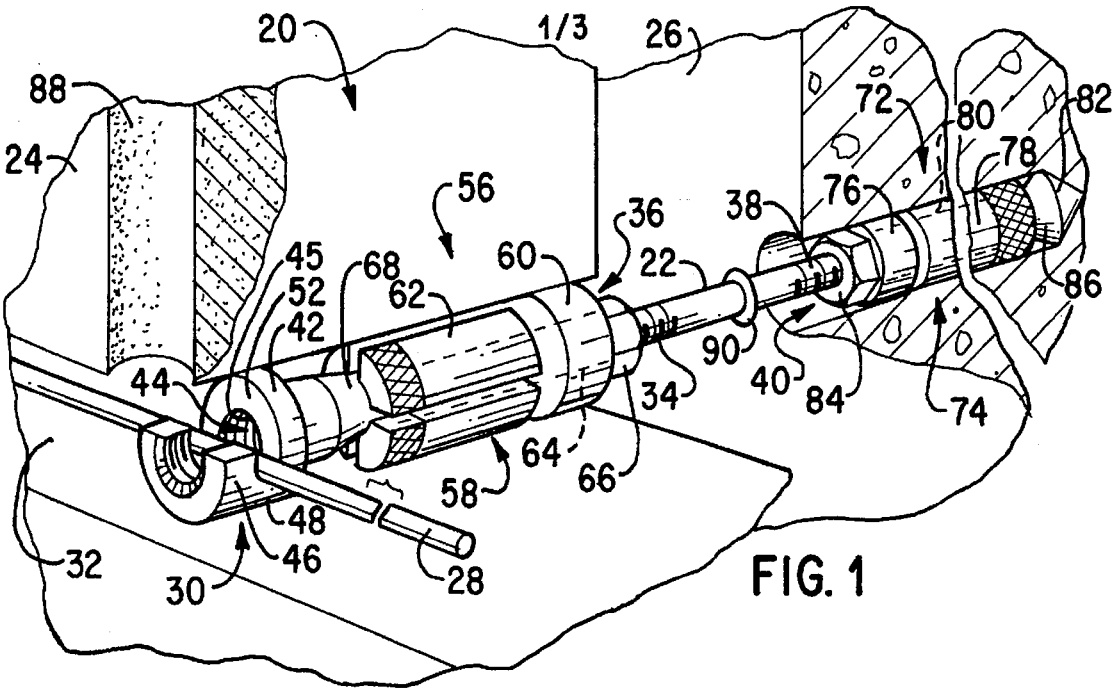
FIG. 1 is a partially cut-away perspective view of a dual wall structure containing a remedial wall anchor system according to the invention.
Figure 2:
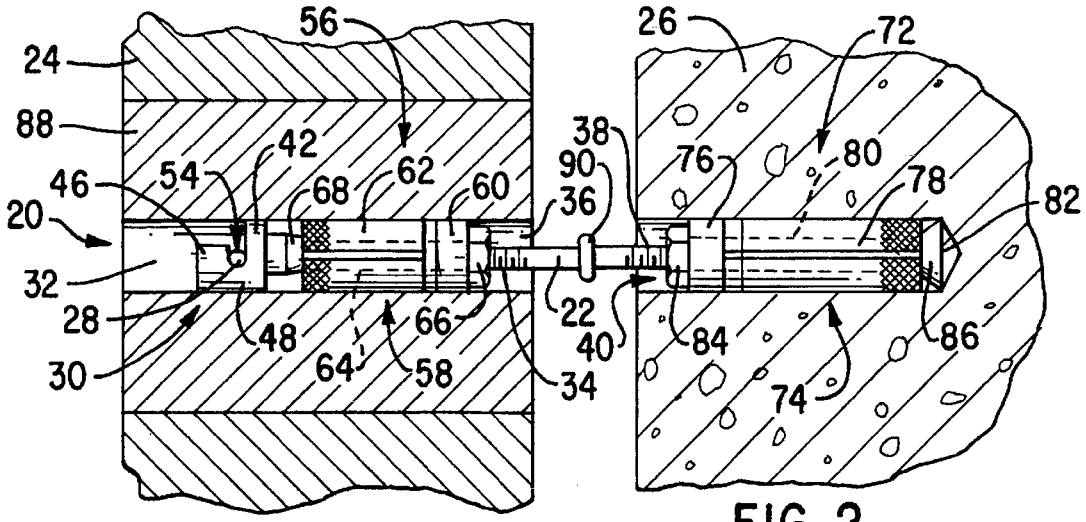
FIG. 2 is a partial side elevational view of the dual wall and anchor system shown in FIG. 1.

Turning now to the figures in which like reference characters indicate like elements throughout, FIGS. 1 and 2 show a remedial wall anchor system 20 according to the invention. System 20 includes a tie member 22 which connects a brick or masonry facade wall 24 to a back-up wall 26, a reinforcing rod or wire 28 extending along facade wall 24, and a capturing device 30 which captures a portion of reinforcing wire 28 to tie member 22. Reinforcing wire 28 is positioned within a groove 32 formed in one of the horizontal mortar joints in facade wall 24 and is proximately located to capturing device 30. Tie rod 22 is insertable through a hole 36 extending through facade wall 24 and extends beyond facade wall 24 for engagement with back-up wall 26. Tie rod 22 is preferably is constructed from stainless steel and has a diameter of about ¼ inch. The front portion 34 of tie rod 22 is positioned within hole 36 in facade wall 24 while the rear portion 38 of tie rod 22 is positioned within hole 40 in back-up wall 26. Hole 36 extends through the entire depth of facade wall 24. The size of hole 40, however, depends on the structure of back-up wall 26. Where back-up wall 26 is a solid structure constructed from concrete, cement blocks, or similar materials, as in the example illustrated in FIGS. 1 and 2, hole 40 need only extend through a portion of the depth of back-up wall 26, as shown most clearly in FIG. 2.

Figure 3:
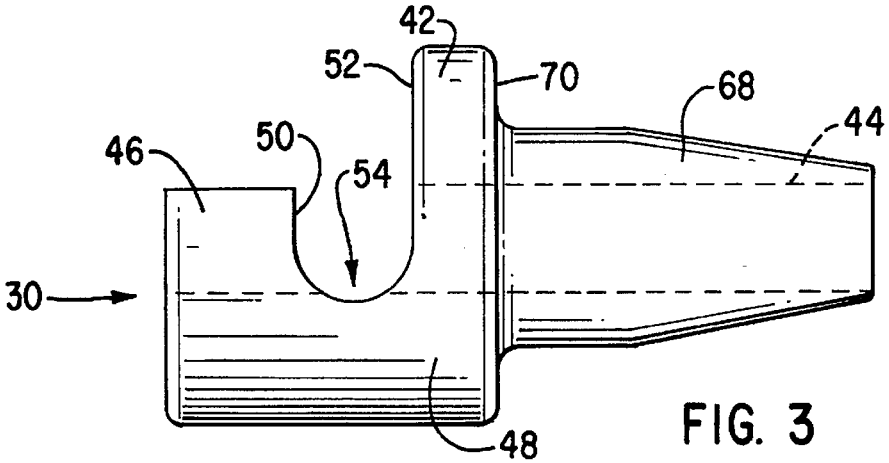
FIG. 3 is an enlarged side elevational view of the capturing device of the remedial anchor system in FIG. 1.

As shown in FIGS. 1–3, capturing device 30 is generally tubular and includes a tubular body 42 having a bore 44 for securing device 30 to tie rod 22. In the preferred embodiment shown in FIGS. 1 and 2, bore 44 has a threaded inner surface 45. In addition, front portion 34 is also threaded. Thus, in the preferred embodiment capturing device 30 is threadably secured to tie rod 22 via threaded bore 44. Alternatively, capturing device 30 can be press-fit or similarly secured to tie rod 22. Capturing device 30 also includes a tab 46 spaced apart from body 42 and a linking member 48 connected to and extending between tab 46 and one end of body 42. Tab 46 is positioned slightly off-center relative to body 42. The inner face 50 of tab 46, the outer end 52 of body 42, and linking member 48 together form a channel 54 for capturing a portion of reinforcing wire 28 to tie rod 22.

A variety of anchors can be used to secure tie rod 22 to facade wall 24 and back-up wall 26. In the embodiment shown in FIGS. 1 and 2, an expandable facade anchor 56 secures tie rod 22 to facade wall 24. Facade anchor 56 includes a body 58, preferably made from brass, having a fixed section 60, an expandable section 62 attached to fixed section 60, and a central bore 64 (shown in phantom) extending through sections 60 and 62. In addition, facade anchor 56 includes a nut 66 which is threadably secured to threaded front portion 34 of rod 22. Facade anchor 56 is assembled on tie rod 22 by first threadably securing nut 66 to portion 34. Body 58 is then slidably positioned on rod 22 so that fixed section 60 is adjacent nut 66 and expandable section 62 extends toward the outer end of rod 22. Facade anchor 56 is activated to secure rod 22 to facade wall 24 by capturing device 30 which, in the embodiment shown in FIGS. 1–3, includes a conical section 68 extending from the inner face 70 of body 42. Conical section 68 is sized to fit within a portion of central bore 64 of anchor 56. In addition, threaded bore 44 also extends though conical section 68, as shown in phantom in FIG. 3, so that body 42 and conical section 68 are generally tubular. After facade anchor 56 is assembled on tie rod 22, capturing device 30 is threadably secured to the outer end of tie rod 22 so that conical section 68 is adjacent expandable section 62 of facade anchor 56, as shown in FIGS. 1 and 2. Thereafter, tightening capturing device 30 against anchor 56 moves at least a portion of conical section 68 into bore 64 thereby expanding section 62 and securing tie rod 22 to facade wall 24.

In the embodiment shown in FIGS. 1–2, an expandable back-up anchor 72 also secures tie rod 22 to back-up wall 26. Back-up anchor 72 includes a body 74, preferably made from brass, having a fixed segment 76, an expandable segment 78, and a central bore 80 (shown in phantom) extending through segments 76 and 78. In addition, back-up anchor 72 includes a wedge nut 82 and a second nut 84 which together fix the position of anchor 72 on tie rod 22 and expand segment 78 to secure tie rod 22 to back-up wall 26. Back-up anchor 72 is assembled on rod 22 by first threadably securing wedge nut 82 to the end of portion 38, which in this embodiment is threaded. Body 74 is then slidably positioned on rod 22 so that expandable segment 78 is adjacent wedge nut 82. The conical section 86 of wedge nut 82 is sized to be at least partly contained within central bore 80 of body 74. Second nut 84 is then threadably secured to rod 22 adjacent fixed segment 76. Anchor 72 is activated to secure tie rod 22 to back-up wall 26 by tightening nut 84 against body 74 so that part of conical portion 86 of wedge nut 82 moves into central bore 80 and expands section 78.

System 20 is easily and economically used to re-connect facade wall 24 to back-up wall 26. Initially, groove 32 is formed in a horizontal mortar joint of facade wall 24.

Groove 32 extends along facade wall 24 and is sized to accommodate reinforcing wire 28 as well as body 42 and tab 46 of capturing device 30. Then, hole 36 is drilled through facade wall 24 so that hole 36 intersects and is normal to horizontal groove 32. In the preferred embodiment, hole 36 is positioned at a T-junction where a vertical mortar joint 84 in facade wall 24 intersects groove 32, as most clearly shown in FIGS. 1 and 5. Thereafter, hole 40 is drilled into back-up wall 26 so that hole 40 is aligned with hole 36. Both holes 36 and 40 are cleaned of debris by using a nylon brush and forced air. Back-up anchor 72 is then assembled on tie rod 22 in the previously described fashion and nut 66 is secured to portion 34. Thereafter, tie rod 22 is inserted into holes 36 and 40 so that backup-anchor 72 is positioned within hole 40 in back-up wall 26. An O-ring 90 can be positioned on tie rod 22 between portions 34 and 38 so that O-ring 90 is located between facade wall 24 and back-up wall 26. O-ring 90 helps conduct moisture and condensate away from anchors 56 and 72.

An activating or setting tool 92, shown in FIGS, 4–6, is used to activate back-up anchor 72 to secure tie rod 22 to back-up wall 26 and to activate facade anchor 56 to secure tie rod 22 to facade wall 24. Tool 92 includes two sections: an elongated rear section 94 used in activating back-up anchor 72, and a cylindrical front section 95 used in activating facade anchor 56. Elongated section 94 has a central threaded bore 96 (shown in phantom) for threadably engaging tie rod 22 and a handle 98 projecting from the outer end of elongated section 94. In addition, elongated section 94 has a pair of outwardly-projecting tangs 99 located opposite handle 98 and sized to engage a pair of slots 100 formed in one end of front section 95, as most clearly shown in FIG. 6. Front section 95 also includes an asymmetrically-shaped head 102 located opposite slots 100. Head 102 includes a shelf 104 which extends outwardly from front section 95. Shelf 106 is centrally off-set and is sized to extend over tab 46 of capturing device 30. In the preferred embodiment shown in FIGS. 4–6, tool 92 is fashioned as two separable components, elongated section 94 and adapter front section 95. Alternatively, adapter front section 95 could be provided with handle means opposite head 102 for applying torque directly to section 95.

Figure 4:
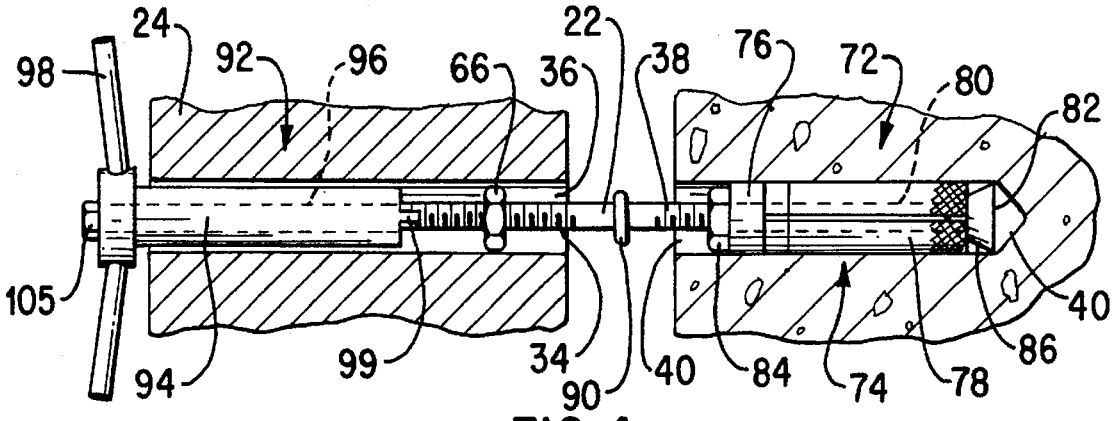
FIG. 4 is a partial side elevational view showing a portion of an setting tool used to secure the anchor system shown in FIG. 1 to the back-up wall.
Figure 5:
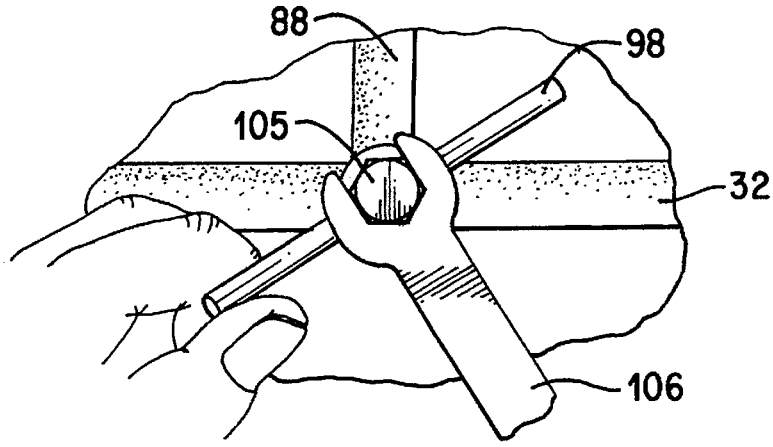
FIG. 5 is a partial front elevational view of the setting tool shown in FIG. 6.

Elongated section 94 is used to activate back-up anchor 72 after back-up anchor 72 and nut 66 have been assembled on tie rod 22, and the entire assembly has been inserted into holes 36 and 40. As shown in FIG. 4, elongated section 94 is first threadably secured to portion 34 of tie rod 22. Thereafter, torque is applied to handle 98 thereby rotating tie member 22 and moving wedge nut 82 against back-up anchor 72. As wedge nut 82 moves against anchor 72, part of conical section 86 moves into bore 80 and causes segment 78 to expand thereby securing rod 22 to back-up wall 26. Generally, expandable segment 78 is correctly tensioned within a torque range of 50 to 100 lbs. Setting tool 92 is then removed from tie rod 22 by simultaneously holding handle 98 firmly while loosening a bolt head 105 on tool 92 with a wrench 106, as shown in FIG. 5. Continued counterclockwise rotation of tool 92 via handle 98 then disengages tool 92 from tie rod 22.

Figure 6:
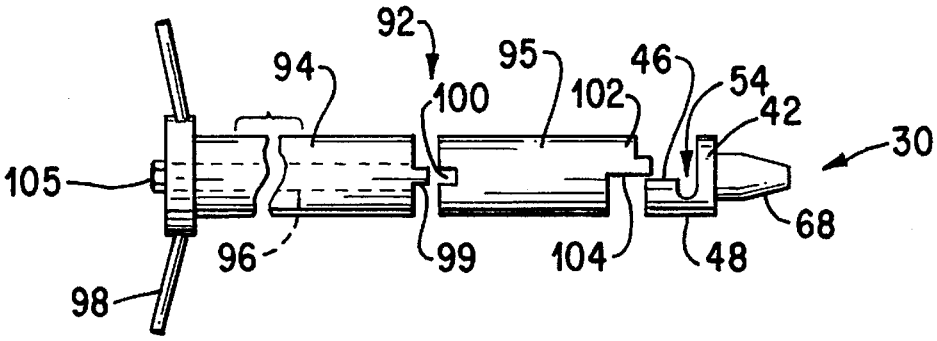
FIG. 6 is an exploded view showing the placement of the setting tool on the capturing device of the anchor system shown in FIG. 1.

After back-up anchor 72 has been activated and tool 92 has been removed from tie rod 22, body 58 of facade anchor 56 is slidably positioned on portion 34 of tie rod 22. Capturing device 30 is then threadably secured to connecting rod 22 so that conical section 68 is adjacent expandable section 62 of facade anchor 56. Tool 92 is then used to activate facade anchor 56 to secure tie rod 22 to facade wall 24. As seen in FIG. 6, front section 95 is first secured to elongated section 94 by positioning front section 95 so that tangs 99 engage slots 100. Thereafter, tool 92 with front section 95 attached thereto is inserted into hole 36 in facade wall 24. Tool 92 is coupled to capturing device 30 aligning tool 92 with device 30 so that shelf 106 extends over and contacts tab 46. Thereafter, applying torque to handles 98 of setting tool 92 causes elongated section 94, front section 95, and capturing device 30 to rotate, thus moving a part of conical portion 68 into bore 64 and expanding section 62 of anchor 56. Expandable section 62 is correctly tensioned within a torque range of 50 to 100 lbs. In addition, capturing device 30 is rotated so that channel 54 is coaxially aligned with groove 32. After tool 92 is removed from capturing device 30, reinforcing wire 28 is placed in horizontal groove 32 and positioned so that capturing device 30 captures a portion of wire 28 in channel 54. Mortar can be placed in hole 36 around anchor 56 and tie rod 22 to further secure anchor 56 and tie rod 22 to facade wall 24. Finally, mortar is applied to groove 32 to cover and embed reinforcing wire 28 within facade wall 24.

Figure 7:
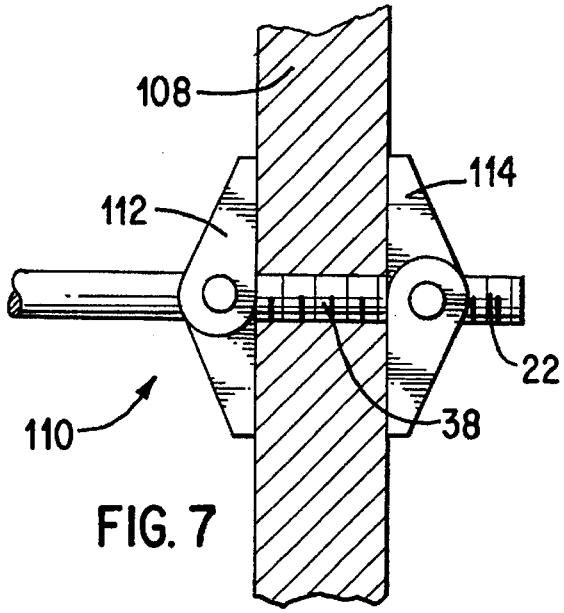
FIG. 7 is a side elevational view of a back-up anchor which can be used with a remedial anchor system according to the invention to secure the anchor system to steel back-up wall components.
Figure 8:
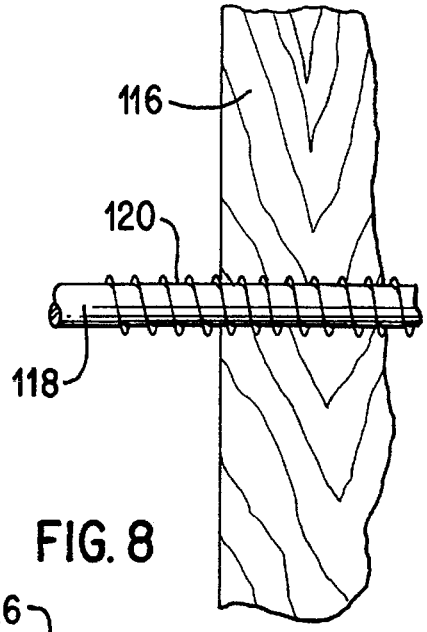
FIG. 8 is a side elevational view of a back-up anchor which can be used with a remedial anchor system according to the invention to secure the anchor system to a wooden back-up wall.

FIGS. 7 and 8 illustrate alternative embodiments of back-up anchors which can be used with facade anchor 56, capturing device 30, and reinforcing wire 28 to re-connect facade wall 24 back-up structures which are not constructed from concrete or similar materials. In FIG. 7, the back-up structure 108 is a light gauge metal stud in the range of 18–22 Ga. In this embodiment, the back-up anchor 110 consists of a pair of toggle bolts 112 and 114. A portion of connecting rod 22 is extends through a hole in back-up structure 108 so that part of tie rod 22 extends beyond structure 108. Toggle bolts 112 and 114 are then threadably secured to tie rod 22 on opposite sides of back-up structure 108. The back-up wall 116 in FIG. 8 is constructed from wood. In this embodiment, a stainless steel connecting rod 118 is itself used as the back-up anchor. Rod 118 includes a portion 120 which is lag-threaded to engage a portion of wooden back-up wall 116.

Figure 9:
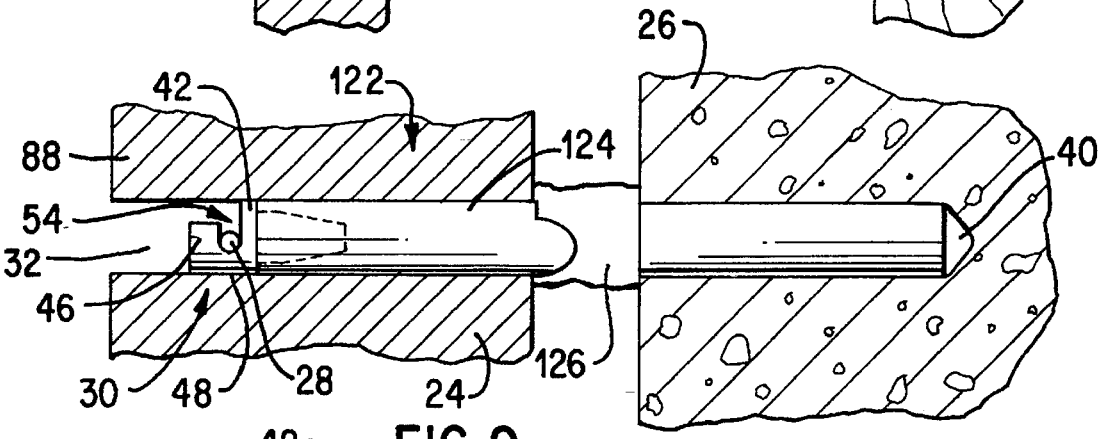
FIG. 9 is a partial side elevational view of an alternative embodiment of a remedial adhesive wall anchor system according to the invention.
Figure 10:
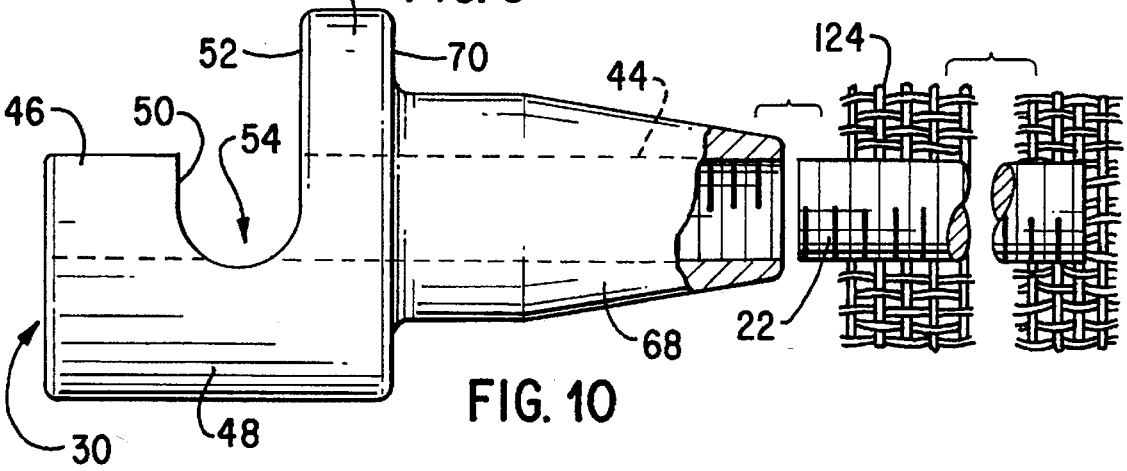
FIG. 10 is a partial enlarged view of the capturing device of the remedial anchor system shown in FIG. 9.

FIGS. 9 and 10 show an alternative embodiment of a remedial wall anchor system 122 according to the invention. Anchor system 122 includes threaded tie rod 22 and capturing device 30 used in conjunction with a tubular wire screen 124 and an adhesive 126. As best seen in FIG. 10, tie rod 22 is threaded to promote bonding with adhesive 126. Adhesive 126 can be of any type suitable for bonding tie rod 22 and screen 124 to facade wall 24 and back-up wall 26 and preferably is a polymer-based epoxy adhesive. Anchor system 122 can be used with a variety of back-up structures, for example, with brick, hollow block, terra-cotta, tile, and concrete. The physical dimensions of tie rod 22 and screen 124 vary according to the wall systems in rod 22 and screen 124 are used. In general, the diameter of screen 124 is about ⅛ inch greater than rod 22. Thus, for example, when rod 22 has a diameter of about ¼ inch, the diameter of screen 124 is chosen to be about ⅜ inch. The length of rod 22 and of screen 124 also vary according to the wall systems in which rod 22 and screen 124 are used. When system 122 is used with a hollow back-up wall, the length of rod 22 is chosen to be ½ inch greater than the sum of the thickness of the facade wall, the thickness of one face of the back-up wall, and the thickness of the gap between the facade wall and the back-up wall. When system 122 is used with a solid back-up wall, the length of rod 22 is chosen to be ½ inch less than the sum of the thickness of the facade wall, the thickness of one face of the back-up wall, and the thickness of the gap between the facade wall and the back-up wall.

In use, after groove 32 is formed in facade wall 24 hole 36 is drilled in facade wall 24 and hole 40 is drilled in back-up wall 26. The diameter of holes 36 and 40 should be substantially equal to the diameter of screen 124. Screen 124 is then filled with adhesive 126 and is immediately placed within holes 36 and 40. Screen 124 defines a channel which permits adhesive 126 to flow rearwardly to back-up wall 26. Next, rod 22 with capturing device 30 threadably secured thereto is inserted into and pushed rearwardly within the adhesive-filled screen 124 in holes 36 and 40. Rod 22 is then rotated within adhesive-filled screen 124 to ensure good contact between the threaded sections of rod 22 and adhesive 124. Additional adhesive 126 may be applied to rod 22 prior to its insertion into screen 124 to promote further bonding of rod 22 to screen 124 and walls 24 and 26. Capturing device 30 and rod 22 are finally rotated so that device 30 is properly positioned for capturing a portion of reinforcing wire 28. After adhesive 126 has set, reinforcing wire 28 is placed within horizontal groove 32 so that a portion of wire 28 is captured in channel 54 of capturing device 30. Finally, mortar can be applied to horizontal groove 32 to cover and embed reinforcing wire 28 within facade wall 24.

Figure 11:
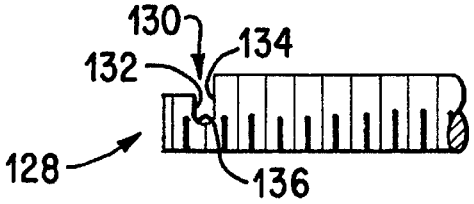
FIG. 11 is a partial side elevational view of an alternative embodiment of a connecting rod which can be used with the system in FIG. 9.

FIG. 11 illustrates an alternative embodiment of a connecting rod 128 which can be used in conjunction with screen 124 and adhesive 126 to re-connect facade wall 24 to back-up wall 26. Unlike rod 22, tie rod 128 has a relatively large outer diameter, on the order of ½ inch or greater. Consequently, rod 128 can itself be machined to include a channel 130 for capturing a portion of reinforcing wire 28. Channel 130 is defined by opposed upstanding surfaces 132 and 134 joined together by a linking surface 136. Tie rod 128 thus eliminates the need for a separate capturing device. In addition, tie rod 128 is threaded to promote bonding with adhesive 126.

Remedial wall anchor systems 20, and 122 can thus be used to reconnect an existing facade wall to an existing back-up wall in building structures which require embedded reinforcing rods or wires because channel 54 of capturing device 30 and channel 130 of tie rod 128 effectively capture a portion of the reinforcing rods or wires which are positioned within the facade wall. Moreover, because of their overall cylindrical configurations, only relatively small portions of the facade wall must be removed and replaced to install systems 20 and 122, specifically the mortar sections removed to form the horizontal groove for the reinforcing rod or wire and the mortar sections removed to form the hole extending through the depth of the facade wall. Consequently, systems 20 and 122 are economically used to re-connect existing facade and back-up walls and to capture a portion of a reinforcing rod or wire to the tie rod connecting the facade and back-up walls without having to remove and replace large portions of the facade walls.

Whereas the present invention has been described with respect to specific embodiments thereof, it will be understood that various changes and modifications will be suggested to one skilled in the art and it is intended that the invention encompass such changes and modifications as fall within the scope of the appended claims.

What is claimed is:

1. A remedial wall anchor system capable of re-connecting an existing facade wall to a back-up wall, comprising:

an elongated reinforcing rod or wire extendable along the facade wall and securable to the facade wall;

a tie member insertable through a hole extending through the facade wall into engagement with the back-up wall, including activation means accessible from a front portion of the tie member for causing the tie member to be connectable with both the facade wall and the back-up wall; and capturing means associated with a front end of the tie member for capturing a portion of the elongated reinforcing rod or wire to the tie member.

2. The remedial wall anchor system of claim 1 wherein the tie member includes on the front portion a threaded end segment, and wherein the capturing means is threadably securable to the threaded end segment of the tie member.

3. The remedial wall anchor system of claim 1 wherein the capturing means comprises first and second spaced-apart upstanding surfaces connected by a linking member to form a channel for holding a portion of the reinforcing rod or wire which abuts and is thereby captured by the upstanding surfaces.

4. The remedial wall anchor system of claim 3 wherein the capturing means further comprises a cylindrical body including a bore for engaging a portion of the tie member to thereby secure the capturing means to the tie member and having an outer face which forms one of the upstanding surfaces.

5. The remedial wall anchor system of claim 4 wherein the capturing means further comprises a conical section extending from an end of the body opposite the outer face, wherein the bore extends through both the body and the conical section.

6. The remedial wall anchor system of claim 4 wherein the tie member includes a threaded end segment and wherein the bore has a threaded surface for threadably securing the capturing means to the threaded end segment of the tie member.

7. The remedial wall anchor system of claim 6 wherein the capturing means further comprises a conical section extending from an end of the body opposite the outer face, wherein the bore extends through both the body and the conical section.

8. The remedial wall anchor system of claim 1 wherein the tie member includes a channel-defining member for allowing an adhesive to flow from the front portion of the tie member rearwardly to the back-up wall.

9. A remedial wall anchor system capable of re-connecting an existing facade wall to a back-up wall, comprising:

an elongated reinforcing member extending along and securable to the facade wall;

an anchor portion adapted to extend between the facade wall and the back-up wall and including an elongated connecting member having a threaded end segment adapted to be at least partially positioned within a hole extending through the facade wall, and means for causing the connecting member to be securable with the facade and backup walls; and a tubular device threadably secured to the threaded end segment of the connecting member and including a tubular body with a tab spaced apart from the body for capturing a portion of the reinforcing member to secure the reinforcing member to the tubular device.

10. The remedial wall anchor system of claim 9 wherein the tubular body has a threaded bore for engaging the threaded end segment of the connecting member.

11. The remedial wall anchor system of claim 10 wherein the tubular device further comprises a conical section extending from an end of the body opposite the tab and wherein the threaded bore extends through the conical section.

12. The remedial wall anchor system of claim 9 wherein the anchor portion includes a channel-defining member for an adhesive, and the elongated connecting member being located within the channel-defining member and securable by the adhesive to thereby secure the anchor portion to the facade wall.

13. The remedial wall anchor system of claim 12 wherein the channel-defining member includes a tubular screen extending from the facade wall and into an aperture in the back-up wall, and the elongated connecting member being inserted into the tubular screen after adhesive is placed therein to bond the elongated connecting member to the screen and the facade and back-up walls.

14. The apparatus of claim 9 wherein the elongated reinforcing member comprises a reinforcing rod or wire located within and securable to the facade wall, and the tubular device includes a linking member attached to and extending between the tab and a first end of the body so that the first end of the body and the tab define a capturing channel for capturing a portion of the reinforcing rod or wire therein so that the reinforcing rod or wire is connectable with the anchor portion.

15. The apparatus of claim 14 further comprising a conical section extending from a second end of the body opposite the tab, and a bore extends through both the body and the conical section.

16. The apparatus of claim 14 wherein the tubular body includes a bore having a threaded inner surface for threadably engaging the threaded end segment of the elongated connecting member.

17. The apparatus of claim 16 further comprising a conical section extending from an end of the body opposite the tab, wherein the threaded bore extends through both the body and the conical section.

18. A method for re-connecting a front facade wall to a rear back-up wall, the front facade wall being already constructed and of the type including at least one elongated mortar line, comprising;

forming an elongated groove along a segment of the mortar line, the elongated groove being substantially parallel to the mortar line;

drilling a hole extending through the facade wall;

inserting a tie member through the hole so that the tie member extends between the facade wall and the back-up wall;

securing from a position in front of the facade wall the tie member to both the facade and back-up walls;

placing a reinforcing rod or wire within the elongated groove such that the reinforcing rod or wire is proximally located to the tie member;

capturing a portion of the reinforcing rod or wire to the tie member; and securing the reinforcing rod or wire to the facade wall to thereby connect and reinforce together the facade wall and the back-up wall.

19. The method of claim 18 wherein the step of securing the tie member to the facade wall and the back-up wall further includes activating from a position in front of the facade wall a mechanical anchor to secure the tie member to the back-up wall.

20. The method of claim 18 wherein the step of securing the tie member to the facade wall and the back-up wall further includes filling the hole with a suitable adhesive which flows along the tie member to the back-up wall so that the adhesive bonds with the facade wall and with the back-up wall.

* * * * *